US005568988A

United States Patent [19]

Knox et al.

[11] Patent Number: 5,568,988

[45] Date of Patent: Oct. 29, 1996

[54] MULTI-PART DISPENSER

[75] Inventors: Gary Knox, Valencia; Nguyen T. Dang, Glendale; John S. Frost, Agoura; Stan Shofner, Pasadena, all of Calif.

[73] Assignee: Courtaulds Aerospace, Inc., Burbank, Calif.

[21] Appl. No.: 506,383

[22] Filed: Jul. 24, 1995

[51] Int. Cl.[6] ..... A46B 11/00

[52] U.S. Cl. ..... 401/40; 401/41; 401/132; 401/133; 401/273

[58] Field of Search ..... 401/40, 41, 132, 401/133, 273

[56] References Cited

U.S. PATENT DOCUMENTS

| | | | |
|---|---|---|---|
| 1,607,768 | 11/1926 | Meusel | 401/41 |
| 3,355,238 | 11/1967 | Schwartzman | 401/41 |
| 3,519,364 | 7/1970 | Truhan | 401/132 X |
| 3,759,259 | 9/1973 | Truhan | 401/132 X |
| 3,964,643 | 6/1976 | Morane et al. | 222/145 |
| 4,387,809 | 6/1983 | Botzler | 206/526 |
| 4,632,244 | 12/1986 | Landau | 206/219 |
| 4,784,506 | 11/1988 | Koreska et al. | 401/132 |
| 4,927,012 | 5/1990 | Rowe | 206/219 |
| 5,069,773 | 12/1991 | Frangioni | 204/299 |

FOREIGN PATENT DOCUMENTS

| | | | |
|---|---|---|---|
| 170721 | 7/1905 | Germany | 401/273 |
| 441654 | 3/1927 | Germany | 401/41 |

OTHER PUBLICATIONS

"Features and Benefits of the Flocon Valve System," Flocon, Inc.

"Two–Part Aerosol Dispenser Employing Puncturable Membranes," David L. Miskell, Copyright 1994.

"Two–Part Aerosol Dispenser Employing A Fusible Plug," David L. Miskell.

*Primary Examiner*—Steven A. Bratlie

*Attorney, Agent, or Firm*—Gifford, Krass, Groh, Sprinkle, Patmore, Anderson & Citkowski, P.C.

[57] ABSTRACT

A two or more part dispenser is provided having an elongated flexible housing which defines an interior chamber. A disc(s) is contained within the chamber and is movable from a closed to an open position. In its closed position, the disc(s) divides the chamber into two or more subchambers, each of which contains a different liquid. A collar is slidably mounted to the housing and coaxially disposed around each disc to maintain the disc in its closed position. Upon displacement of the collar away from the disc, a finger on the collar compresses the housing an displaces the disc to its open position thus allowing the two or more liquids in the subchambers to intermix together. A dispensing nozzle assembly having an outlet is fluidly connected by a fluid passageway to the housing chamber. A normally closed valve is positioned in series with this passageway so that, when the valve is moved to its open position, liquid within the housing chamber is dispensed out through the nozzle outlet.

11 Claims, 2 Drawing Sheets

MULTI-PART DISPENSER

BACKGROUND OF THE INVENTION

1. Field of the Invention

The present invention relates generally to liquid dispensers and, more particularly, to a liquid dispenser for a two or more part liquid.

2. Description of the Prior Art

There are many previously known two-part liquid dispenser for intermixing and then dispensing the intermixed liquid from the dispenser. Many of these previously known dispensers utilize frangible components within the housing which, when broken, enable the liquids to intermix with each other. Many of these prior art devices are complex and often require a secondary application device.

None of these previously known two-part dispensers, however, have been particularly suitable for dispensing polyurethane based paint or epoxy coatings. Furthermore, none of the previously known two-part dispensers have utilized a valve for selectively dispensing the intermixed liquid within the housing chamber.

A still further disadvantage of these previously known two-part dispensers, and especially the dispensers which utilize frangible components to enable intermixing of the liquids, is that the frangible components can break before mixing of the liquids is desired. In many cases, premature intermixing of the two liquids effectively destroys the dispenser.

A still further disadvantage of many of these previously known two-part dispensers is that the volume of the subchambers is fixed and thus unable to accommodate different liquids with different mixing ratios. Also, most of them cannot easily accommodate more than two parts.

SUMMARY OF THE PRESENT INVENTION

The present invention provides a two or more part dispenser which overcomes all of the disadvantages of the previously known two-part dispensers.

In brief, the two or more part dispenser of the present invention discloses an elongated flexible housing which defines an interior chamber. At least one disc is contained within the housing and the disc is movable from a closed to an open position.

In its closed position, the disc(s) divides the housing chamber into tow or more subchambers, each adapted to contain a different liquid. For example, one liquid could comprise a resin and the other liquid a curing agent of a polyurethane based paint.

In order to prevent premature displacement of the disc, a collar is slidably disposed around the housing. The collar is dimensioned so that, with the disc in its closed position and the collar is coaxially positioned around the disc, the collar compresses the housing in between the disc and the collar and protects the disc against displacement and the resulting intermixing of the two liquids. Conversely, when the collar is slid along the housing so that it is no longer coaxially aligned with the disc, a finger on the collar compresses the housing on a portion of the disc and displaces the disc from its closed to its open position. In doing so, the disc enables the liquids in the two subchambers to intermix with each other prior to dispensing from the housing.

A dispensing nozzle assembly having an outlet, an inlet and a fluid passageway is secured to the housing so that the inlet of the nozzle is open to the housing chamber. A normally closed valve is fluidly positioned in series in the nozzle passageway. When the valve is moved to its open position, the valve allows the intermixed liquid in the housing chamber to flow out through the nozzle in the desired fashion.

The two or more part dispenser of the present invention has been found to be particularly useful for dispensing polyurethane-based paints and epoxies.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
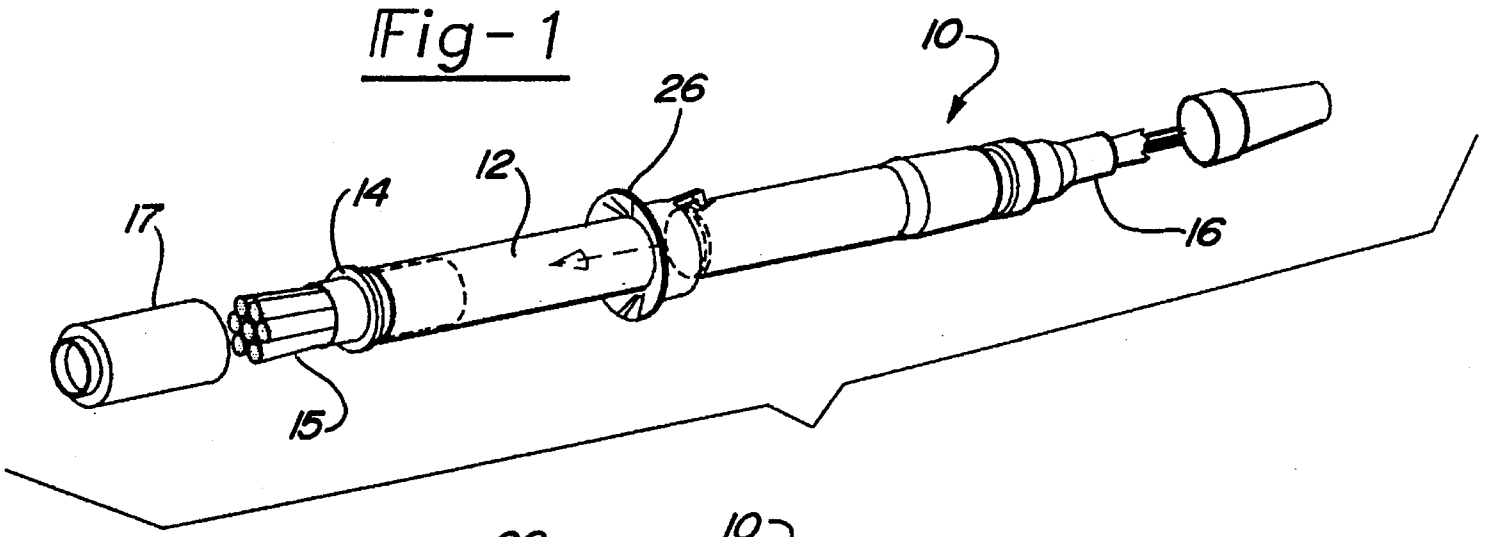
FIG. 1 is a perspective view illustrating a preferred embodiment of the present invention.
Figure 2:
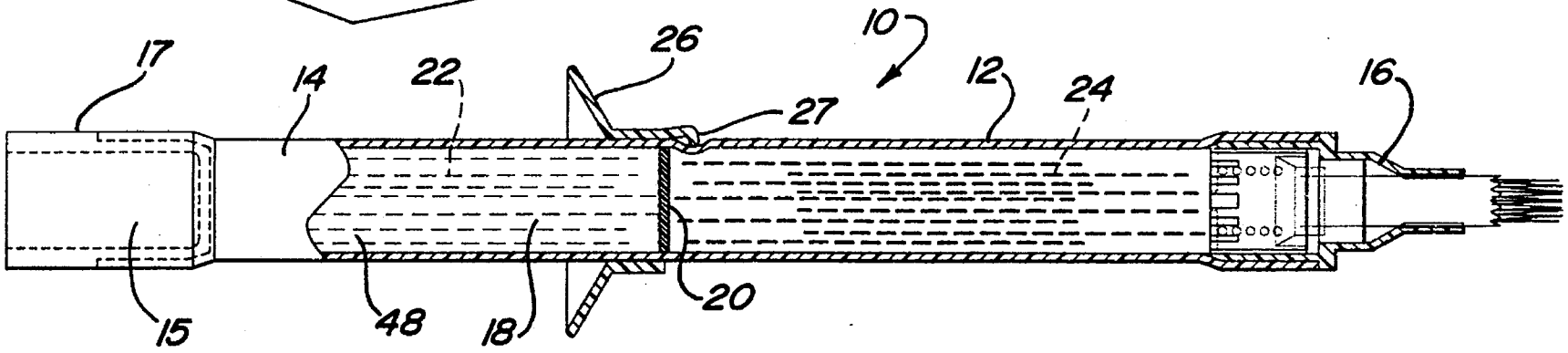
FIG. 2 is a longitudinal sectional view illustrating the preferred embodiment of the present invention.

With reference first to FIGS. 1 and 2, a preferred embodiment of the two-part dispenser 10 of the present invention is there shown and comprises an elongated tubular and cylindrical housing 12. The housing 12 is made of a coextruded flexible plastic material that allows little permeability of gas or liquid and is closed at one end by a cap 14 and at its other end by a nozzle assembly 16. An application brush 15 is preferably secured to the cap 14 and is itself selectively covered by a removable cap 17.

Referring now particularly to FIG. 2, the housing 12 thus defines an interior housing chamber 18 within the interior of the housing 12 and between the cap 14 and nozzle assembly 16. The cap 14 and nozzle assembly 16, furthermore, can be secured to the housing 12 in any conventional fashion, such as a press fit, adhesive, or the like.

Figure 3:
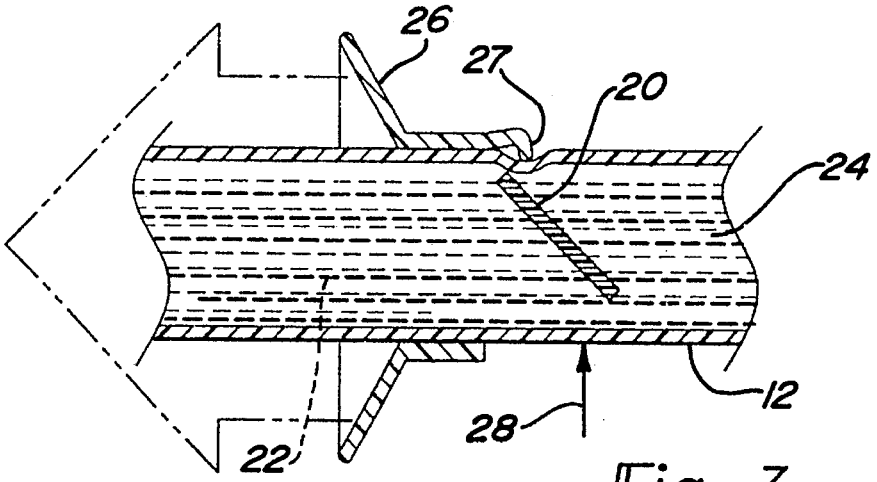
FIG. 3 is a fragmentary sectional view illustrating a portion of the preferred embodiment of the present invention.

With reference now to FIGS. 2 and 3, a circular disc 20 is positioned within the interior chamber 18 of the housing 12 and is movable from a closed position, illustrated in FIG. 2, to an open position, illustrated in FIG. 3. In its closed position (FIG. 2) the disc 20 divides the housing chamber 18 into two subchambers 22 and 24.

Each subchamber 22 and 24 is adapted to contain a predefined liquid. For example, the chamber 22 can contain a resin for a polyurethane based paint while the subchamber 24 contains the curing agent.

The longitudinal position of the disc 20 is infinitely adjustable within the housing chamber 18. Thus, the volume ration of the subchambers 22 and 24 can be varied to different liquids with different mixing ratios. Various housing lengths are also easily accommodated.

In order to prevent intermixing of the liquids 22 and 24, it is necessary to maintain the disc in its closed position (FIG. 2). To accomplish this, a tubular and cylindrical collar 26 is slidably disposed around the exterior of the housing 12. The collar 26 is constructed of a rigid material and has an inside diameter slightly smaller than the outside diameter of the housing 12. Thus, with the collar 26 positioned coaxially around the disc 20 when the disc 20 is in its closed position (FIG. 2), the collar 26 compresses the housing between the disc 20 and collar 26. This compression of the housing 12 prevents displacement of the disc 20 from its closed position and also enhances the fluid seal between the disc 20 and the interior of the housing 12. Furthermore, the collar 26 is constructed of a rigid material which protects the disc 20 from displacement from its closed position during storage and transport.

Figure 5:
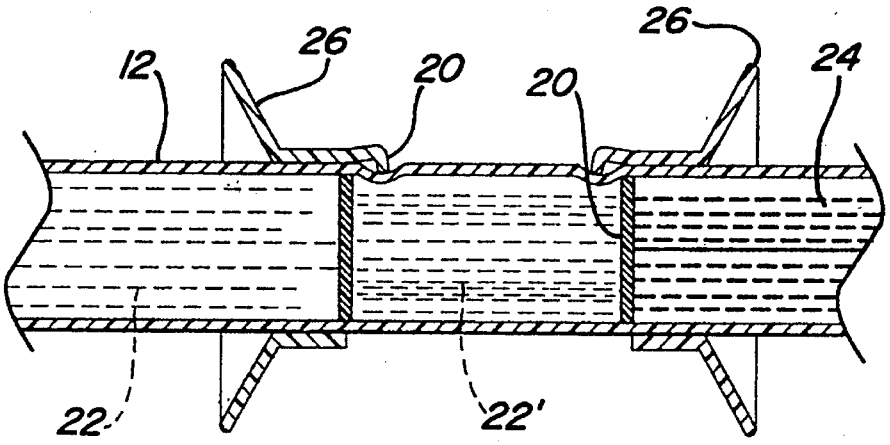
FIG. 5 is a fragmentary sectional view illustrating a further embodiment of the present invention.

With reference now to FIG. 5, the housing 12 can be divided into three or even more subchambers 22, 22' and 24 which adjacent subchambers are separated by a disc 20. One collar 26 is associated with each disc 20. Furthermore, the position of the discs 20 are infinitely adjustable within the housing 12 so that the volume ratios of the subchambers 22, 22' and 24 are likewise infinitely adjustable.

With reference now particularly to FIG. 3, when it is desired to intermix the liquids in the subchambers 22 and 24, the collar 26 is first slid to the position shown in FIG. 3 so that it is no longer coaxially mounted around the disc 20. In doing so, a radially inwardly extending finger 27 on the collar 26 compresses the housing 12 around the disc 20 and automatically dislodges the disc 20. Alternatively, the housing 12 is manually compressed, as indicated by arrows 28 thus displacing the disc 20 from its closed position (FIG. 2) to its open position (FIG. 3). In its open position, the disc 20 enables the liquids in the subchambers 22 and 24 to intermix with each other.

Figure 4:
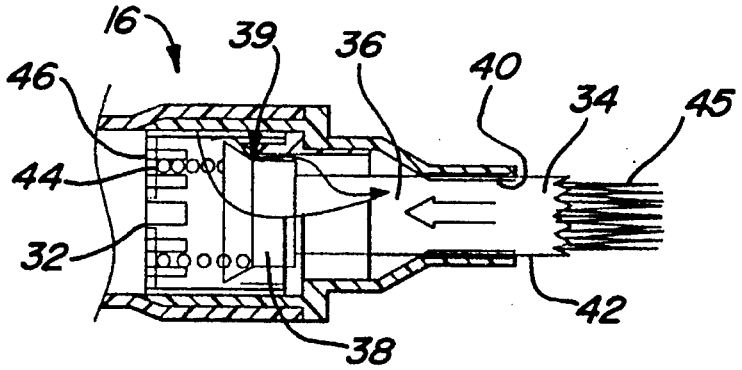
FIG. 4 is a fragmentary longitudinal sectional view illustrating the nozzle assembly of the preferred embodiment of the present invention.

With reference now particularly to FIG. 4, the nozzle assembly 16 is there shown in greater detail. Any conventional and commercially available nozzle assembly 16 can be used. As shown, however, the nozzle assembly 16 includes an inlet 32 open to the housing chamber 18, and outlet 34 and a fluid passageway 36 fluidly connecting the inlet 32 to the outlet 34. A valve member 38 and cooperating valve seat 39 is fluidly disposed in series with the passageway 36 and is movable between a closed position, illustrated in solid line in FIG. 4, and an open position, illustrated in phantom line in FIG. 4. In its closed position, the valve member 38 engages its seat 39 and prevents fluid flow through the passageway 36 and thus prevents the intermixed liquid within the housing chamber 18 from dispensing out through the outlet 34. Conversely, when the valve member 38 is in its open position (phantom line) liquid flows from the chamber 18 and out through the outlet 34.

Still referring to FIG. 4, an elongated valve actuator 40 is secured to the valve member 38 and has an end 42 which protrudes outwardly from the nozzle assembly outlet 34. A compression spring 44 is entrapped between a cage 46 of the nozzle assembly 16 and the valve member 38. This spring 44 normally urges the valve member 38 to its closed position.

In order to open the valve member 38, the valve actuator 40 is depressed thus moving the valve member 38 to its open position and enabling the intermixed liquid in the housing chamber 18 to be dispensed. Brush bristles 45 are also preferably attached to the actuator 40 to facilitate the application of the intermixed liquid.

In operation and with the disc 20 and collar 26 in the position illustrated in FIG. 2, the liquids in the subchambers 22 and 24 are maintained separate from each other. Simultaneously, the collar 26 not only enhances the fluid seal between the housing 12 and disc 20, but also protects the disc 20 from displacement as might occur from impact during shipping.

When use of the dispenser is desired, the collar 26 is slid to the position illustrated in FIG. 3 thus displacing the disc 20 to its open position. The liquids in the subchambers 22 and 24 are then intermixed together by shaking the dispenser 10. If desired, a mixing ball 48 (FIG. 2) may be placed in the chamber 18 to facilitate mixing.

After the liquids have been intermixed, the actuator 40 is positioned against the surface to be treated and the actuator is depressed thus opening the valve member 38 against the force of the spring 44. The housing 12 may be compressed thus forcing the intermixed liquid out through the nozzle outlet 34 in the desired fashion or the intermixed liquid is dispersed by the force of gravity through the nozzle assembly 16. The brush bristles 45 also facilitate the application of the intermixed liquid on the surface. Furthermore, the layer application brush 15 (FIG. 1) may be used to spread the intermixed liquid over a layer area as required.

From the foregoing, it can be seen that the present invention provides a simple and yet highly effective two or more part dispenser for liquids. The present invention has been found to be particularly useful for "touch up" painting in the aeronautical industry.

Having described our invention, however, many modifications thereto will become apparent to those skilled within the art without deviation from the spirit of the invention as defined by the scope of the appended claims.

We claim:

1. A multiple part liquid dispenser comprising an elongated flexible housing defining an interior chamber, a disc contained within said chamber and movable from a closed to an open position, said disc in said closed position dividing said interior chamber into a first and second subchamber, said first subchamber adapted to contain a first liquid and said second subchamber adapted to contain a second liquid, wherein displacement of said disc to said open position enables said first and second liquids to intermix, a dispensing nozzle assembly having an outlet, an inlet and a fluid passageway between said inlet and said outlet, said inlet being fluidly connected with said interior chamber, said nozzle assembly including a normally closed valve in series with said fluid passageway, a collar axially slidably mounted around an outer periphery of said housing, said collar having an inside diameter smaller than the outside diameter of said housing so that when said collar is aligned with said disc in said closed position, said housing is compressed between said disc and said collar to thereby prevent displacement of said disc to said open position and simultaneously fluidly seal an outer periphery of said disc to an inner periphery of said housing in said closed position.

2. The invention as defined in claim 1 wherein said valve comprises a valve actuator movable between an extended and a retraced position, said valve actuator protruding outwardly from said outlet.

3. The invention as defined in claim 2 and comprising a compression spring for urging said actuator toward said extended position.

4. The invention as defined in claim 1 wherein said first liquid is a resin and said second liquid is a curing agent.

5. The invention as defined in claim 2 and comprising a brush secured to said actuator.

6. The invention as defined in claim 1 wherein said collar is made of a rigid material.

7. The invention as defined in claim 1 wherein said housing is circular in cross-sectional shape.

8. The invention as defined in claim 1 and comprising means for automatically displacing said disc from said closed position to said open position as said collar is axially slid along said housing.

9. The invention as defined in claim 8 wherein said automatic displacing means comprises a finger secured to said collar, said finger extending inwardly from said collar and compressing a portion of said housing.

10. The invention as defined in claim 1 and comprising an application brush secured to an end of the housing opposite from said nozzle assembly.

11. The invention as defined in claim 1 and comprising a second disc contained within said housing and spaced from said first mentioned disc, said second disc dividing one of said subchambers into two smaller chambers whereby said housing contains three separate liquids.

* * * * *